US005320277A

United States Patent [19]

Stout et al.

[11] Patent Number: 5,320,277

[45] Date of Patent: Jun. 14, 1994

[54] ARTICLE CARRIER REINFORCING STRUCTURE

[75] Inventors: James T. Stout, Ellijay; James B. Demaio, Marietta, both of Ga.

[73] Assignee: The Mead Corporation, Dayton, Ohio

[21] Appl. No.: 89,710

[22] Filed: Jul. 9, 1993

[51] Int. Cl.[5] ..... B65D 5/46

[52] U.S. Cl. ..... 229/117.13; 229/242; 229/920

[58] Field of Search ..... 229/40, 117.13, 242–244, 229/920, DIG. 4; 206/427

[56] References Cited

U.S. PATENT DOCUMENTS

| | | | |
|---|---|---|---|
| 2,276,363 | 3/1942 | Zalkind | 229/DIG. 4 |
| 2,474,523 | 6/1949 | Guyer | 229/920 |
| 2,681,143 | 6/1954 | Guyer | 206/427 |
| 2,797,856 | 7/1957 | Jaeschke | 229/117.13 |
| 2,911,136 | 11/1959 | Stone | 229/117.13 |
| 3,076,591 | 2/1963 | Nute et al. | 229/117.13 |
| 3,904,036 | 9/1975 | Forrer | 206/427 |
| 3,994,432 | 11/1976 | Kirby, Jr. | 206/427 |
| 4,304,332 | 12/1981 | Danti | 206/427 |
| 4,331,289 | 5/1982 | Killy | 206/427 |
| 4,396,143 | 8/1983 | Killy | 206/427 |
| 4,577,799 | 3/1986 | Oliff | 206/427 |
| 4,679,725 | 7/1987 | Wilson | 229/117.13 |

FOREIGN PATENT DOCUMENTS

| | | | |
|---|---|---|---|
| 2206564 | 1/1989 | United Kingdom | 229/117.13 |

*Primary Examiner*—Gary E. Elkins
*Attorney, Agent, or Firm*—Rodgers & Rodgers

[57] ABSTRACT

An article carrier having bottom, top, side and end walls interconnected to form an enclosure of rectilinear configuration and having a pair of spaced apart hand hole openings formed in the top wall includes a reinforcing strip secured to the inner surface of the top wall and between the hand hole openings. End extensions which may or may not be adhered project from each end of the reinforcing strip and are folded into flat face contacting relation with the end walls respectively and are secured thereto. The fold lines between the end extensions and the cooperating end edges of the reinforcing strip are debossed so as to protrude inwardly and mate with a complementary embossed area which is encased by torque relief slits thereby reducing the tension along the outer surfaces of the fold lines between the top wall and the end walls so as effectively to strengthen the load bearing elements of the carrier top wall.

11 Claims, 5 Drawing Sheets

ARTICLE CARRIER REINFORCING STRUCTURE

TECHNICAL FIELD

This invention relates generally to hand carried article carriers and is particularly concerned with the construction of hand gripping apertures and related reinforcing means.

BACKGROUND ART

U. S. Pat. No. 2,849,112 issued Aug. 26, 1958 discloses a can carrier of the wrap around type in which the can chimes both top and bottom are arranged so as to reside in slits formed in the top and bottom edges of both side walls. Chimed cans under adverse conditions may tear the end corners of the carrier and thus effectively destroy the package. A pair of spaced scores are formed astride an inwardly folded panel and form embossments which reinforce the carrier at the upper and lower corners thereof at both ends of the carrier.

U. S. Pat. No. 2,872,036 issued Feb. 3, 1959 discloses a paperboard wrap around carrier for cans having inwardly folded reinforcing strips disposed about the end edges of the carrier and in which parallel double score lines are formed at the carrier corners which are out of alignment with the packaged can chimes and which thereby serve to strengthen the carrier.

U. S. Pat. No. 2,933,867 issued Apr. 26, 1960 includes an incidental disclosure of short slits formed at the top and bottom end corners of the carrier which serve to prevent tearing of the carrier structure due to the fact that these small slits are disposed in transverse relation to the carrier corners and close to the ends of the wrapper both top and bottom.

SUMMARY OF THE INVENTION

According to this invention in one form, an article carrier having bottom, top, side and end walls interconnected to form an enclosure of rectilinear configuration includes a pair of spaced apart hand hole openings formed in the top wall. A reinforcing strip is secured to the inner surface of the top wall between the hand hole openings and includes end extensions projecting from each end of the reinforcing strip and folded into flat face contacting relation with the end walls respectively and secured thereto. The fold lines between the end extensions and the cooperating end edges of the reinforcing strip are embossed so as to protrude inwardly thereby to reduce the tension and the tendency for rupture to occur along the outer surfaces of the fold lines between the end extensions of the reinforcing strip and the part of the reinforcing strip which is secured to the carrier top walls so as effectively to strengthen the load bearing elements of the carrier.

This invention is concerned with embossing the fold line between the portion of a reinforcing strip secured to the inner surface of the top wall and foldably joined to the outwardly extended projection secured to the end wall. This embossed structure may take several forms according to this invention as shown in fragmentary FIGS. 5A, 5, 6, 7 and 8. These embossments may be enhanced in effectiveness if short slits SS are used as indicated.

BEST MODE OF CARRYING OUT THE INVENTION

Figure 1:
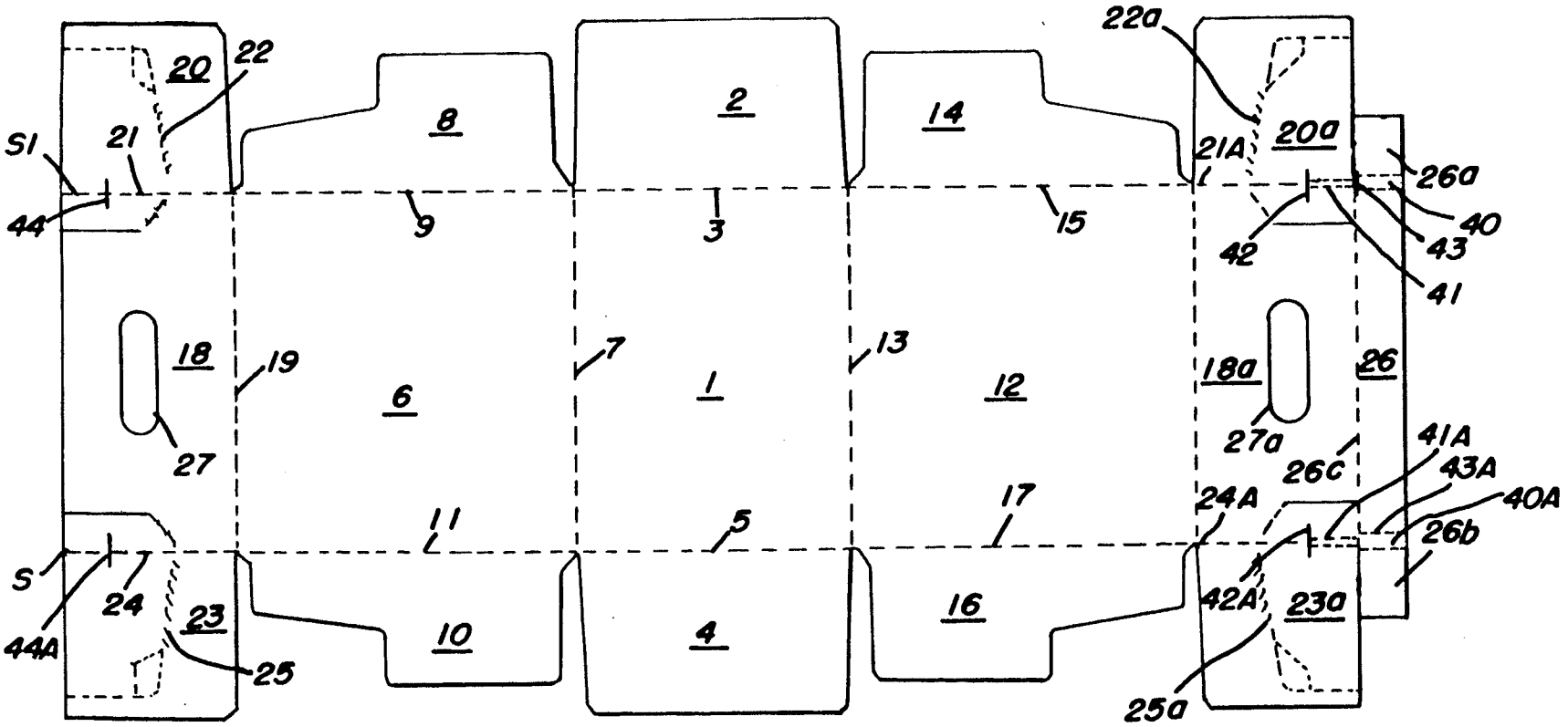
FIG. 1 is a plan view from the inside of a carrier blank formed according to this invention.

With reference to FIG. 1, the numeral 1 designates the bottom wall of the carrier. Bottom end flap 2 is foldably joined to a end edge of bottom wall 1 along fold line 3. Bottom end flap 4 is foldably joined to bottom wall 1 along fold line 5.

Side wall 6 is foldably joined to a side edge of bottom wall 1 along fold line 7. A side end flap 8 is foldably joined to side wall 6 along fold line 9. Side end flap 10 is foldably joined to side wall 6 along fold line 11.

At the other end of the blank, side wall 12 is foldably joined to bottom wall 1 along fold line 13. Side end flap 14 is foldably joined to side wall 12 along fold line 15. Side wall flap 16 is foldably joined to side wall 12 along fold line 17.

The top wall of the carrier according to this invention is formed of parts located at opposite ends of the blank shown in FIG. 1. Top wall panel 18 is foldably joined to side wall 6 along a fold line 19. Top end flap 20 is foldably joined to an end edge of top wall panel 18 along fold line 21. Portions of a tear strip formed in part in top wall panel 18 and in part in top end flap 20 are designated by the numeral 22. At the other end of top wall panel 18 top end flap 23 is foldably joined to top wall panel 18 along fold line 24. A tear strip 25 is formed in part in top end flap 23 and in part in top wall panel 18.

A hand hole aperture 27 is formed in top wall panel 18 and is of well known construction.

The top panel 18*a* at the opposite end of the blank from top panel 18 is identical to panel 18 in all respects except that reinforcing strip 26 is foldably joined to panel 18*a* along fold line 26*c*. This reinforcing strip has an end portion 26*a* at one end and a similar end portion 26*b* at the other end. The numerals used in connection with top panel 18*a* are duplicates of the numerals used in connection with top panel 18 except for the addition of the suffix a. The top end flaps associated with top wall panel 18*a* are designated by the numerals 20*a* and 23*a*. Tear strip 22*a* and tear strip 25*a* designate the tear strips similar to those at the opposite end of the blank.

Figure 2:
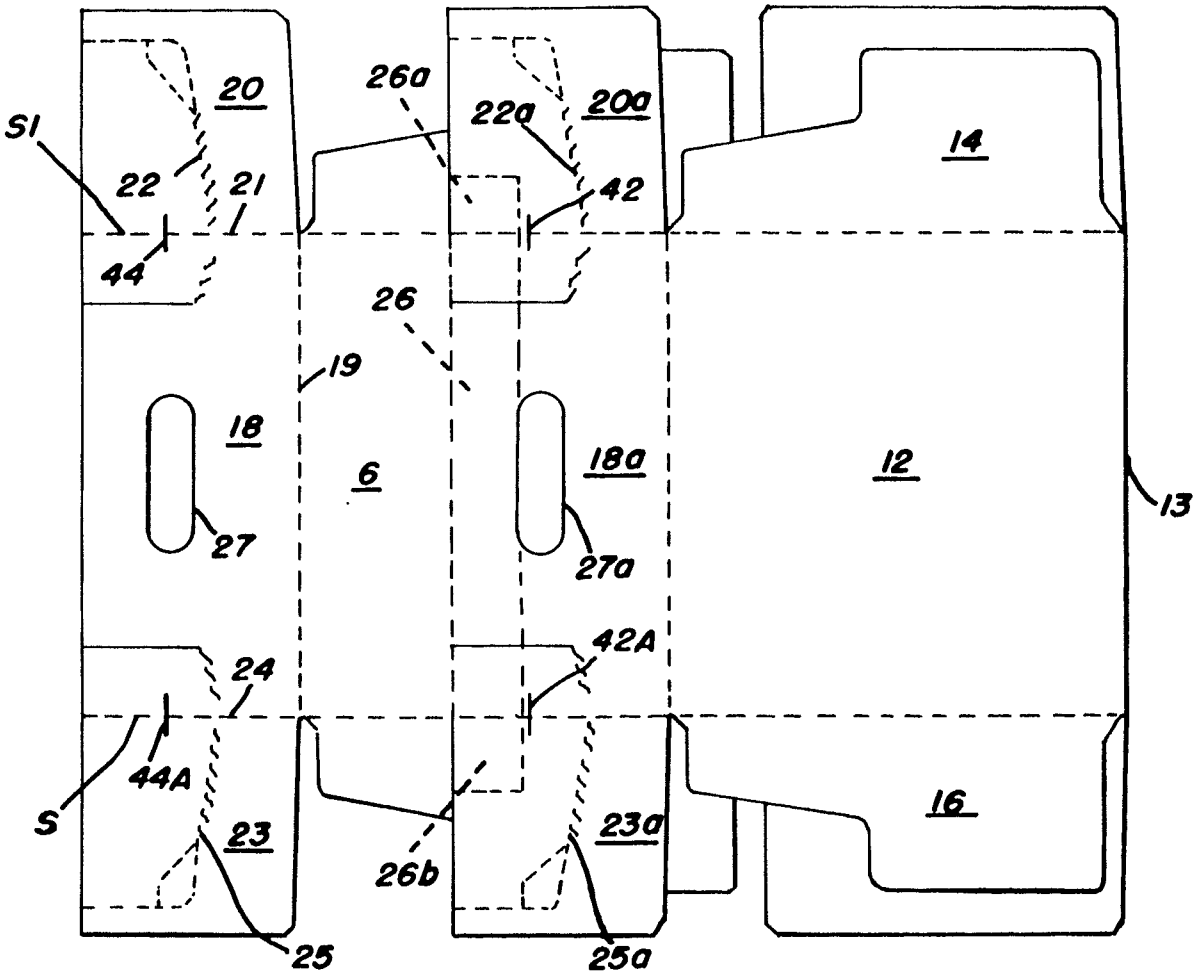
FIG. 2 shows a reinforcing strip 26 in dotted lines and folded into flat face contacting relation with the top wall panel 18*a* and with the side wall 12 and parts associated therewith folded upwardly and toward the left along fold line 13 so as to occupy the position represented by FIG. 2.

An application of glue is made to reinforcing strip 26 and to its end portions 26*a* and 26*b*. The strip 26 and its ends are then folded up and to the left along fold line 26*c* and side wall 12 and elements associated therewith are folded up and to the left along fold line 13. The structure with 26, 26A, 26B shown as dotted lines then appears as shown in FIG. 2.

Figure 3:
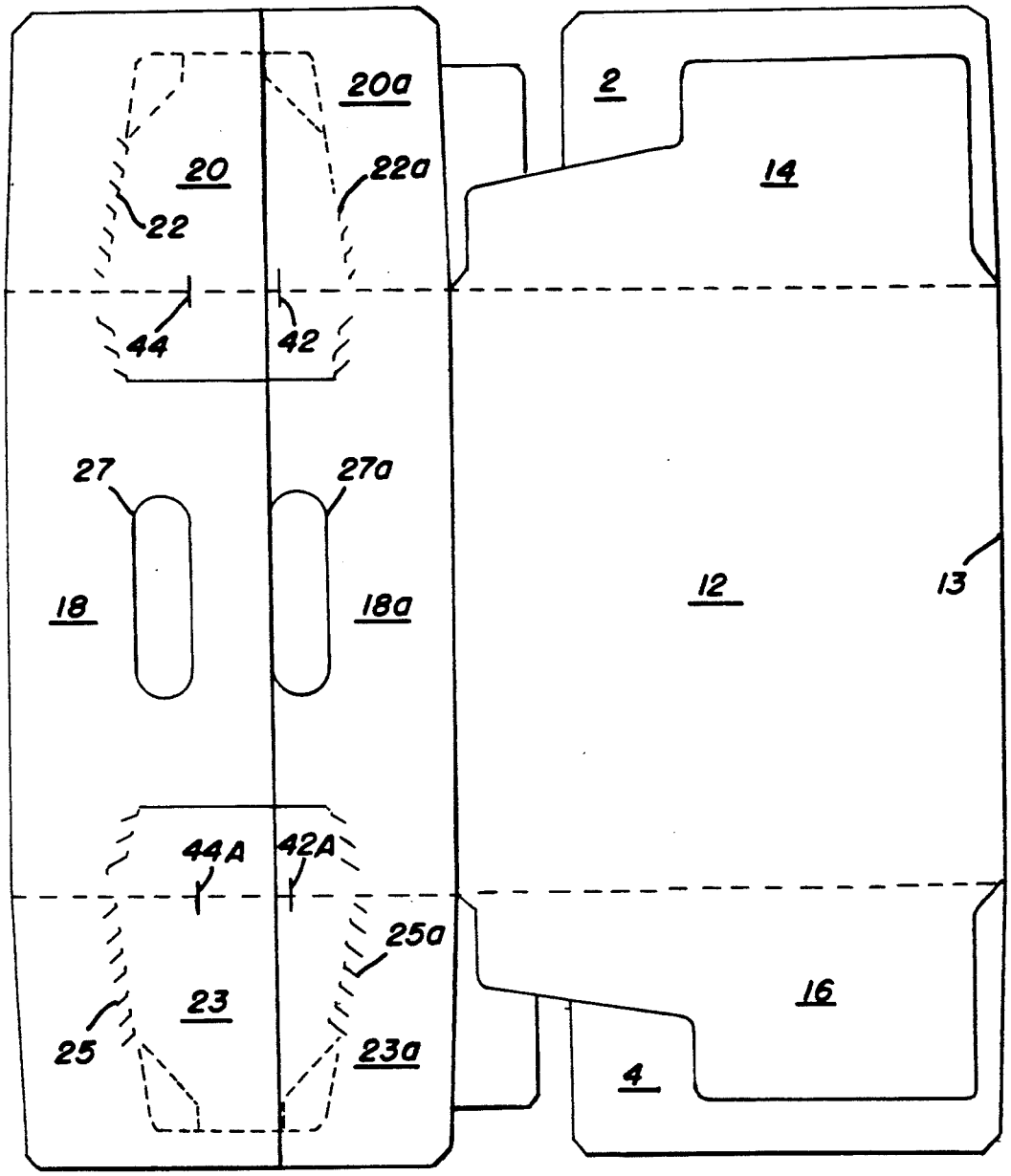
FIG. 3 is a view of the carrier in completed but collapsed condition.

Glue is then applied to top panel 18 and to end panels 20 and 23 and these panels are folded toward the right along fold line 19. The carrier then appears in completed collapsed condition as shown in FIG. 3.

Figure 4:
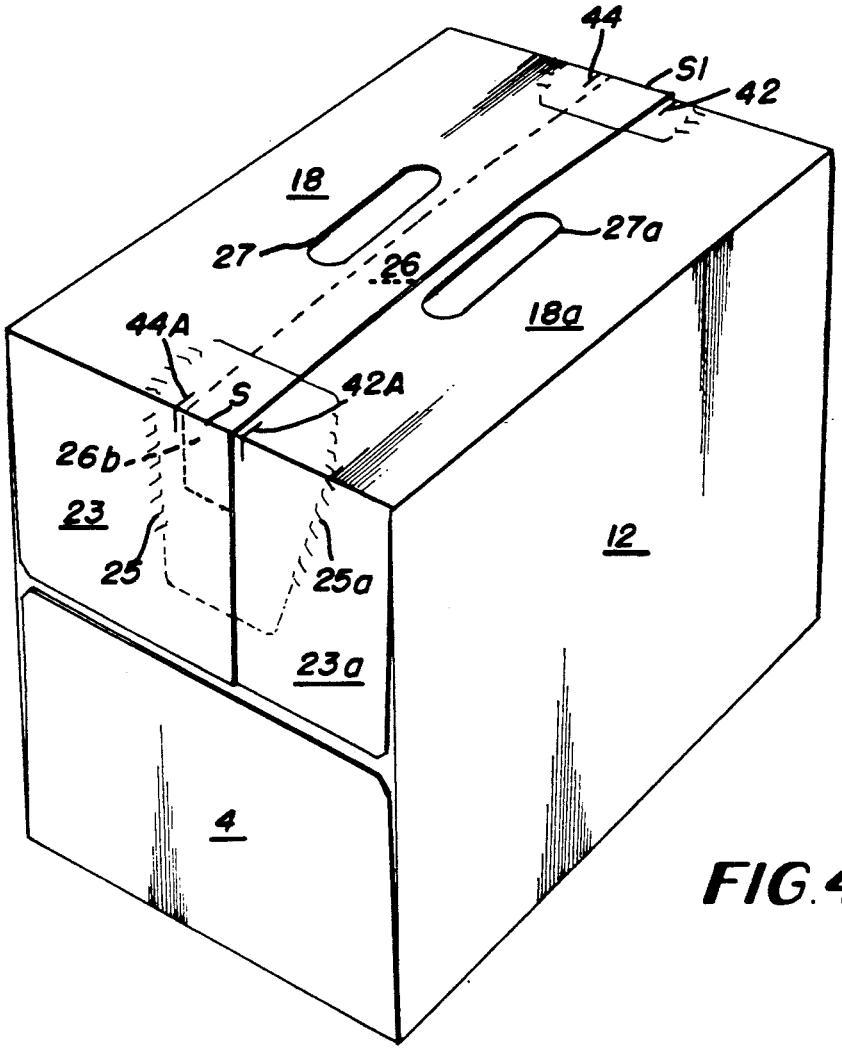
FIG. 4 is simply a set up perspective view of a carrier formed according to the blank of FIG. 1.

When the carrier is set up it appears as shown in FIG. 4.

One condition which tends to weaken the overall handle structure is attributed to the fact that the reinforcing strip such as indicated by the numeral 26 is arranged with its end portions 26*a* and 26*b* folded downwardly. This downward folding places a substantial stress along the line of fold and on the outer surfaces of the fold lines between the major part 26 of the reinforcing strip and its end parts 26*a* and 26*b*. The principal purpose of this invention is to minimize or to eliminate the tendency for excessive stress to be placed at the points indicated at S and S1 as best shown in FIG. 1. In order to minimize the stress due to folding of the reinforcing strip, the reinforcing strip is debossed by causing a narrow channel such as parts designated 40 and 40A to be formed in a debossed fashion. This embossment then effectively removes from the points of stress a considerable amount of material which thus substantially limits and may eliminate altogether the tendency for the reinforcement strip and related adhered structures to become weakened at stress points such as S and S1 where the end portions 26*a* and 26*b* of the reinforcing strip are folded downwardly at approximately 90 degrees to the main body of the strip 26.

Figure 5A:
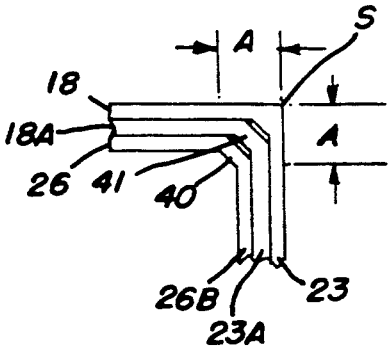
Figure 5:
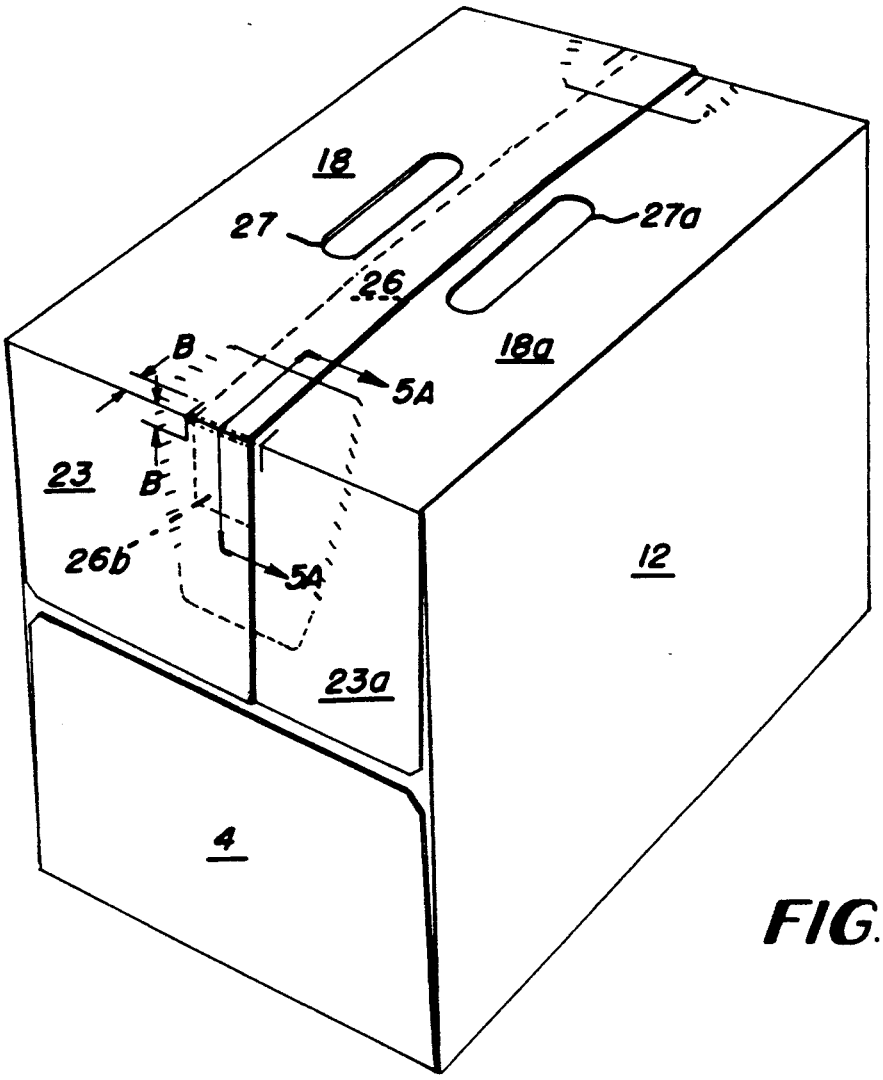

FIGS. 5 and 5A show the application of the invention to a top end of a carton and depict an inner layer 26 and 26B adjacent to a debossed channel 40. A middle layer 18A and 23A adjacent to an embossed channel 41 and an outer layer 18 and 23 adjacent to fold line 24 which is associated with stress point S. As explained these elements greatly enhance the carton strength and are of general application beyond the specific use of the invention as applied to a carton such as shown in FIGS. 4 and 5. The width of the embossed channel is approximately ⅛ inch and of the debossed channel is approximately 3/16 inch.

Figure 6:
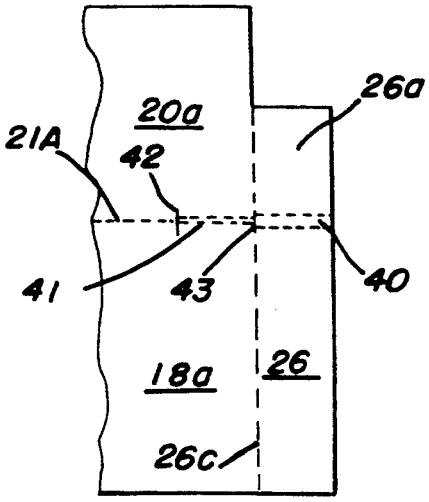
Figure 8:
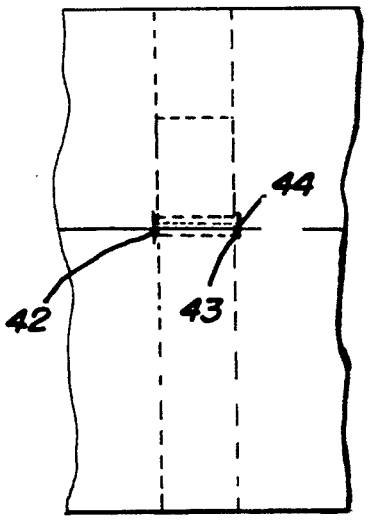

FIGS. 4, 6 and 8 show a fragment of a carton blank including reinforcement strip 26 foldably joined to top panel 18*a*and includes torque relief slits 42, 43 and 44.

The term torque relief slits denotes parallel slits which isolate the build up of material in areas such as S and S1 best shown on FIG. 4 from areas outside the area between the parallel slits.

Figure 7:
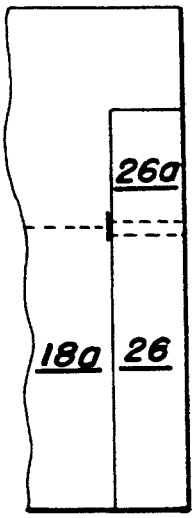

FIG. 7 shows the reinforcing strip 26 and 26*a* after they are folded into contact with top panel 18*a* and end wall panel 23*a*.

FIG. 8 is a view similar to FIG. 7 but shows torque relief slits or cuts 42, 43 and 44. All of the short slits shown in the drawings are torque relief slits. Only slits 40, 43 and 44 are identified with numerals.

As is shown in FIG. 6 the width of the embossed areas is greater than other embossments and a pair of torque relief slits 42 and 43 are formed in the top wall and in adjacent parts of the associated end walls.

The debossed areas 40 and 40A of the end extension 26*a* and 26*b* of the reinforcing strip are the largest width of the channels. Also torque relief slits are formed adjacent the ends of embossed and debossed areas and are disposed astride the fold line between the top and end walls of the carton.

As is clear from FIG. 5A, the mating channels 40 and 41 may be associated with a third sheet of paperboard having an embossed channel 24 which may not mate with channels 40 and 41.

Also the third sheet of paperboard 18 and 23 is characterized by a smaller degree of embossment.

A pair of torque relief slits 42, 43 and 44 are disposed adjacent the ends of embossed and debossed mating surfaces.

In FIG. 5 the dimensions B are shown. These measurements must be at least as long as distance A shown in FIG. 5A.

This invention is well suited for use with medium to heavy caliper paperboard.

We claim:

1. An article carrier comprising bottom, top, side and end walls each having an inner surface interconnected to form an enclosure in which said top wall includes load bearing elements in which adjacent parts of said end walls are associated with said top wall, a pair of spaced apart hand hole openings are formed in said top wall, a reinforcing strip having cooperating end edges secured to the inner surface of said top wall and between said hand hole openings, fold lines between said top and end walls, end extensions projecting from each of said cooperating end edges of said reinforcing strip and folded along fold lines into flat face contacting relation with said inner surfaces of the adjacent end walls respectively and secured thereto, the tension between the outer surfaces of the fold lines between said end extensions and the cooperating end edges of said reinforcing strip having debossed channels and the adjacent inner surface of each carrier end wall having an embossed channel having an inner end and embossed areas of a lesser width than said debossed reinforcing channel so as to protrude inwardly and interact with torque relief slits thereby reducing the tension along the outer surfaces of said fold lines so as effectively to strengthen the load bearing elements of the carrier top wall.

2. An article carrier according to claim 1 wherein the width of said embossed channel is approximately ⅛ of an inch.

3. An article carrier according to claim 1 wherein the width of said debossed channel is approximately 3/16 of an inch.

4. An article carrier according to claim 2 wherein the first torque relief slit (42) is disposed astride the fold line between said top wall and said end wall and the second torque relief slit (43) is disposed adjacent the inner end of said embossed channel.

5. An article carrier according to claim 1 wherein said embossed areas include inner ends and which are formed at the fold lines between the ends of said reinforcing strip and said end extensions respectively and wherein the inner ends of said embossed areas are disposed adjacent the short torque relief slit disposed astride the fold lines between said top and end walls respectively.

6. An article carrier according to claim 1 wherein the width of said embossed areas is the larger of said embossed areas and wherein the pair of torque relief slits are formed in said top wall and in adjacent parts of the associated end walls and closely adjacent said embossed areas.

7. An article carrier according to claim 1 wherein said debossed areas of said end extensions of said reinforcing strip are the largest in width of said channels and wherein a pair of end torque relief slits are formed adjacent the ends of said embossed and debossed areas and astride the fold lines between said top wall and said end walls respectively.

8. A first sheet of paperboard having a debossed channel, a second sheet of paperboard having an embossed channel width is of comparable size and configuration to said embossed channel of said first sheet and said channels having mating surfaces.

9. A combination of paperboard sheets defined in claim 8 wherein a third sheet of paperboard having an embossed channel of different dimensions than the dimensions of said mating surfaces may overly but not mate with said mating surfaces.

10. First and second sheets of paperboard according to claim 8 wherein a third sheet of embossed paperboard is characterized by a smaller degree of embossment than claim 8.

11. The combination of claim 8 wherein a pair of transverse torque relief slits are disposed adjacent the ends of said mating surfaces.

* * * * *